US008973796B1

(12) United States Patent
Abusaoud et al.

(10) Patent No.: US 8,973,796 B1
(45) Date of Patent: Mar. 10, 2015

(54) SERVING TRAY APPARATUS

(76) Inventors: Mustafa Abusaoud, St. Thomas, VI (US); Ali Abusaoud, St. Thomas, VI (US)

( * ) Notice: Subject to any disclaimer, the term of this patent is extended or adjusted under 35 U.S.C. 154(b) by 43 days.

(21) Appl. No.: 13/595,539

(22) Filed: Aug. 27, 2012

(51) Int. Cl.
*A47G 23/06* (2006.01)
*B65D 1/34* (2006.01)
*A47B 23/00* (2006.01)

(52) U.S. Cl.
CPC ..... *B65D 1/34* (2013.01); *A47B 23/002* (2013.01)
USPC ..... 224/218; 224/222

(58) Field of Classification Search
CPC ..... A47B 23/002; A47G 23/0625; A47G 19/065; A47G 23/06; B65D 1/34
USPC ..... 224/218, 222, 148.1, 148.4, 148.7; 220/556, 914; 294/142; 206/549
See application file for complete search history.

(56) References Cited

U.S. PATENT DOCUMENTS 7,360,666 B1 * 4/2008 Primel et al. ..... 220/759
2010/0230419 A1 * 9/2010 Joseph ..... 220/574

* cited by examiner

*Primary Examiner* — Adam Waggenspack
(74) *Attorney, Agent, or Firm* — Michael I. Kroll

(57) ABSTRACT

A serving tray apparatus comprising a container support portion and a hand/forearm engaging portion incorporating a mechanism for releasably attaching the container support portion to the hand/forearm engaging portion.

1 Claim, 20 Drawing Sheets

SERVING TRAY APPARATUS

BACKGROUND OF THE INVENTION

1. Field of the Invention

The present invention relates generally to trays and, more specifically, to a serving tray apparatus having a rigid plate-like beverage container-support portion and a hand/forearm engaging portion.

The beverage container-support portion provides at least one rigid plate-like tray having a plurality of apertures or cavities for receiving and supporting a beverage container in a respective aperture/cavity thereby preventing lateral movement of said container once placed within a respective aperture/cavity.

The beverage container-support portion further incorporates at least one of a pair of mating fasteners for attaching the container supporting portion to the hand/forearm-engaging portion.

The hand/forearm-engaging portion having a longitudinal body provides the mating fastener to said beverage container-support portion fastener whereby the container-support portion is fastened to the hand/forearm-engaging portion that further comprises a downwardly depending hand grip and a channeled forearm brace.

The hand/forearm-engaging portion adds stability to handling the tray by virtue of the hand grip and channeled forearm brace. In other words, as the tray's center of balance changes while the tray is being carried from one location to another and when the tray's containers are removed, it becomes more difficult to balance a serving tray with one hand.

Further more, the terminus ends of the vertically depending hand grip and forearm brace, which is basically a pair of spaced apart downwardly depending wings, are substantially coplanar thereby providing a three point stand for the serving tray apparatus when placed on a horizontal surface, such as a table.

2. Description of the Prior Art

There are other serving trays designed for serving beverages. While these trays may be suitable for the purposes for which they were designed, they would not be as suitable for the purposes of the present invention, as hereinafter described.

It is thus desirable to provide a serving tray incorporating a container-support portion and a hand/forearm engaging portion.

It is further desirable to provide a serving tray having spaced apart container-support portion with the top tray having a plurality of spaced apertures and the bottom tray supporting the base of a beverage container.

SUMMARY OF THE PRESENT INVENTION

A primary object of the present invention is to provide a serving tray apparatus having a container-support portion and a hand/forearm-engaging portion.

Another object of the present invention is to provide a serving tray apparatus wherein the forearm-engaging portion comprises a downwardly depending hand grip and forearm brace having a pair of spaced apart wings.

Yet another object of the present invention is to provide a serving tray apparatus wherein said forearm-engaging portion further provides one of a pair of mating fasteners while the other mating fastener forms an integral part of the container-support portion enabling the container-support portion to be fastened to the hand/forearm-engaging portion.

Still yet another object of the present invention is to provide a serving tray apparatus wherein said hand/forearm-engaging portion comprises a longitudinal body having at least one of a mating fastener forming an integral part therewith and a downwardly depending hand grip and channeled forearm brace terminating in a pair of spaced apart wings.

An additional object of the present invention is to provide a serving tray apparatus where the container-support portion fastener and the hand/forearm-engaging portion fastener are threadedly engaged.

A further object of the present invention is to provide a serving tray apparatus where the container-support portion fastener and the hand/forearm-engaging portion fastener are a dove tail rail and dove tail channel.

A yet further object of the present invention is to provide a serving tray apparatus where the hand/forearm engaging portion accommodates a pair of spaced apart container-support trays through another pair of mating fasteners comprising a threaded cavity within the hand/forearm-engaging fastener and a threaded post downwardly extending from one of the container-support trays so that the bottom container-support tray is fastened to the hand/forearm-engaging fastener with the treaded post threadedly attached to said threaded cavity with the length of the threaded post keeping the two trays in a spaced relationship.

A still yet further object of the present invention is to provide a serving tray apparatus wherein said container-supporting portion comprises at least one rigid plate-like container supporting portion having a plurality of spaced apart apertures for supporting containers therein.

Another object of the present invention is to provide a serving tray apparatus wherein said container-support portion comprises at least one rigid plate-like container-supporting portion having a plurality of spaced cavities for supporting containers therein.

Yet another object of the present invention is to provide a serving tray apparatus further comprising a container-supporting portion having an upper tray with apertures and a subjacent tray with cavities that are co-aligned with the upper tray's apertures thereby supporting the base of a beverage container within a respective subjacent tray cavity while the beverage container's upper wall is contained within a respective aperture.

Still yet another object of the present invention is to provide a serving tray apparatus further comprising a container-support portion having an upper tray with apertures and a subjacent ring fixedly attached to said upper tray wherein said ring extends fully or partial across the upper tray apertures thereby supporting the base of a beverage container upon said fixedly attached ring.

An additional object of the present invention is to provide a serving tray apparatus further comprising a container-support portion having an upper tray with apertures and a subjacent ring with a plurality of spacers fixedly positioned between said upper tray and said ring wherein said ring extends fully or partial across the upper tray apertures thereby supporting the base of a beverage container upon said fixedly attached ring.

A further object of the present invention is to provide a serving tray apparatus wherein said container-supporting portion having said plurality of spaced apertures for supporting container therein, further provides flanged receptacles for receiving and supporting a beverage container therein with said receptacle flange supported along the periphery of said apertures.

A yet further object of the present invention is to provide a serving tray apparatus wherein said container-support portion comprises at least one rigid plate-like tray having a plurality of apertures wherein said plurality of apertures optionally provides each aperture with a recess extending from the aperture through the edge of the tray thereby enabling goblets/stemware glasses to be inserted by their stems into a respective recess with the glass bowl portion supported by the rim of the aperture.

A still yet object of the present invention is to provide a threaded cap for said threaded post whereby said threaded cap forms a handle for carrying the serving tray apparatus.

Additional objects of the present invention will appear as the description proceeds.

The present invention overcomes the shortcomings of the prior art by providing a serving tray apparatus having a rigid plate-like container-supporting portion and a hand/forearm-engaging portion.

The container-support portion provides at least one rigid plate-like tray having a plurality of apertures or cavities for receiving and supporting a container in a respective aperture/cavity Further provided is at least one of a pair of mating fasteners taken from the group of threaded and dovetail for releasably attaching the container supporting portion to the hand/forearm engaging portion.

The hand/forearm engaging portion provides at least one of a mating fastener for releasably attaching the container-support portion to the hand/forearm engaging portion that further comprises a downwardly depending hand grip and forearm brace, where the forearm bracket has a channel with opposing channel sides with depending wings.

Further more, the terminus ends of the vertically depending hand grip and forearm brace are substantially coplanar thereby providing a three point stand for the serving tray apparatus when placed on a horizontal surface, such as a table.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 11:
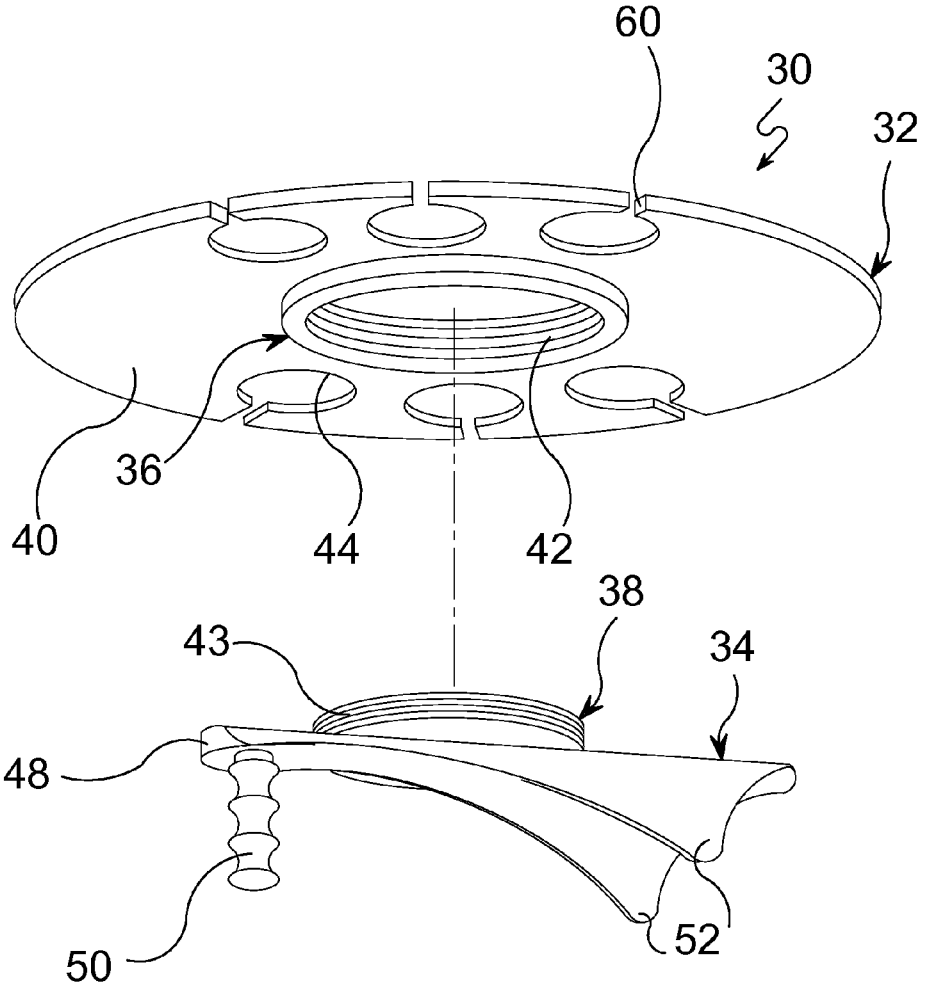

FIG. 11 is an exploded bottom perspective view of the serving tray apparatus of the present invention using a threaded fastener for attaching the container support portion to the hand/forearm engaging portion further providing each aperture with a slot extending from the aperture to the edge of the serving tray whereby stemmed beverage containers can be inserted into a respective aperture through the respective slots.

Figure 12:
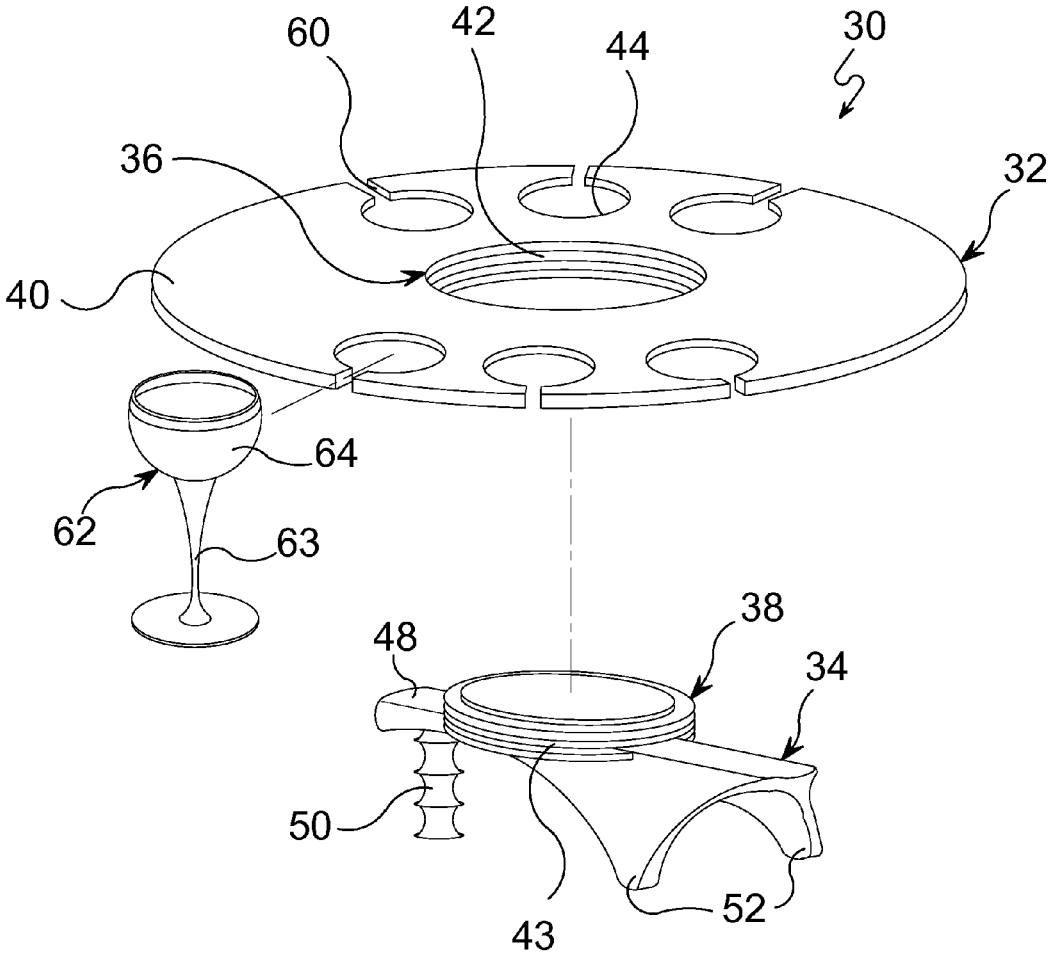

FIG. 12 is an exploded top perspective view of the serving tray apparatus of the present invention using a threaded fastener for attaching the container support portion to the hand/forearm engaging portion further providing each aperture with a slot extending from the aperture to the edge of the serving tray whereby stemmed beverage containers can be inserted into a respective aperture through the respective slots.

Figure 13:
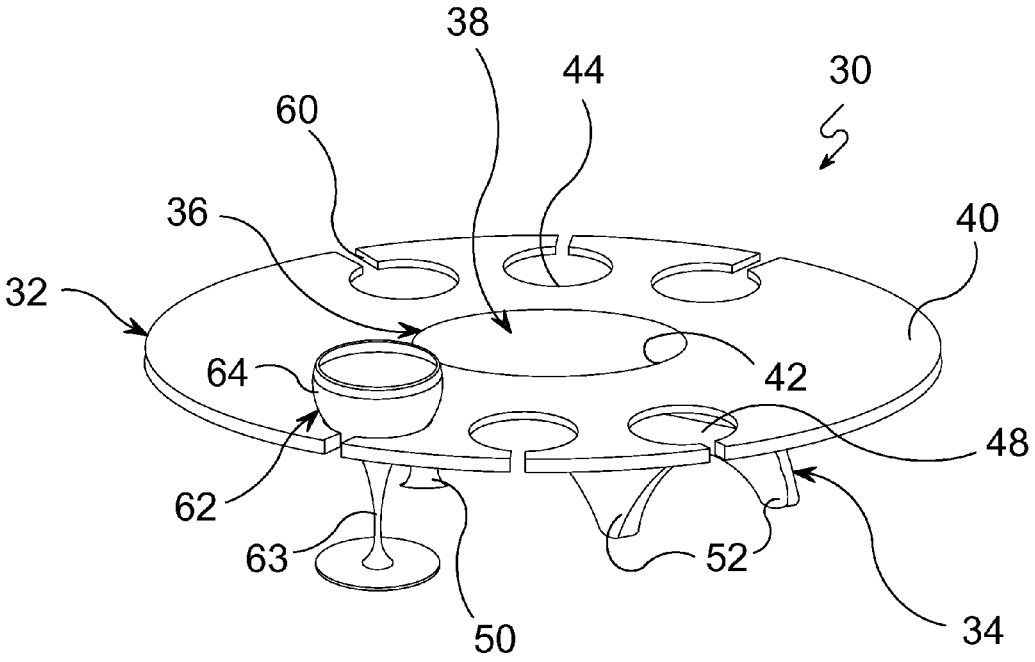

FIG. 13 is an assembled top perspective view of the serving tray apparatus of the present invention using a threaded fastener for attaching the container support portion to the hand/forearm engaging portion further providing each aperture with a slot extending from the aperture to the edge of the serving tray whereby stemmed beverage containers can be inserted into a respective aperture through the respective slots.

Figure 14:
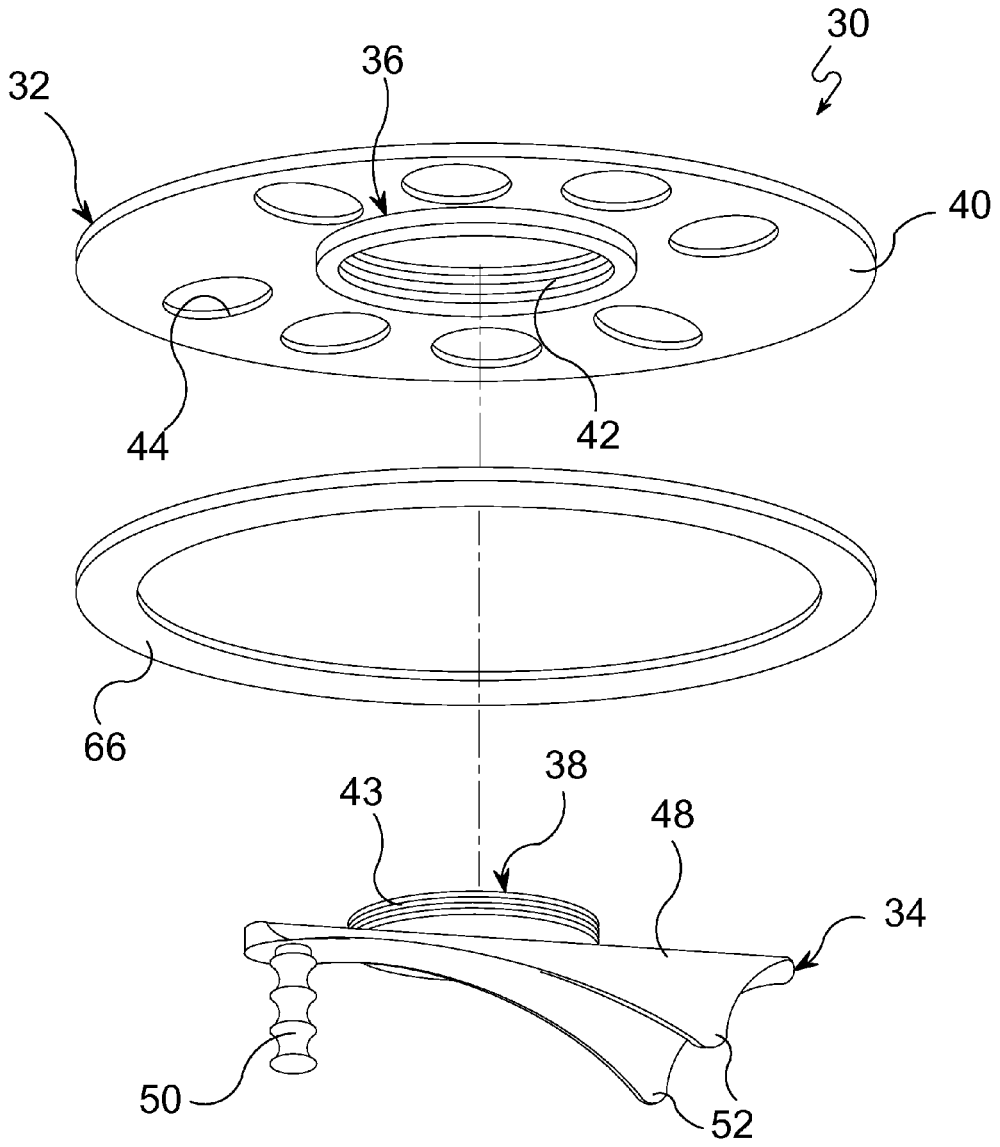

FIG. 14 is a bottom exploded perspective view of the serving tray apparatus of the present invention whereby the container support portion is comprised of an upper ridged plate having a centrally disposed threaded through bore with a plurality of arrayed apertures and a subjacently positioned lower ring that extends fully or partially across the plurality of arrayed apertures thereby supporting the base of a beverage container on the lower ring.

Figure 15:
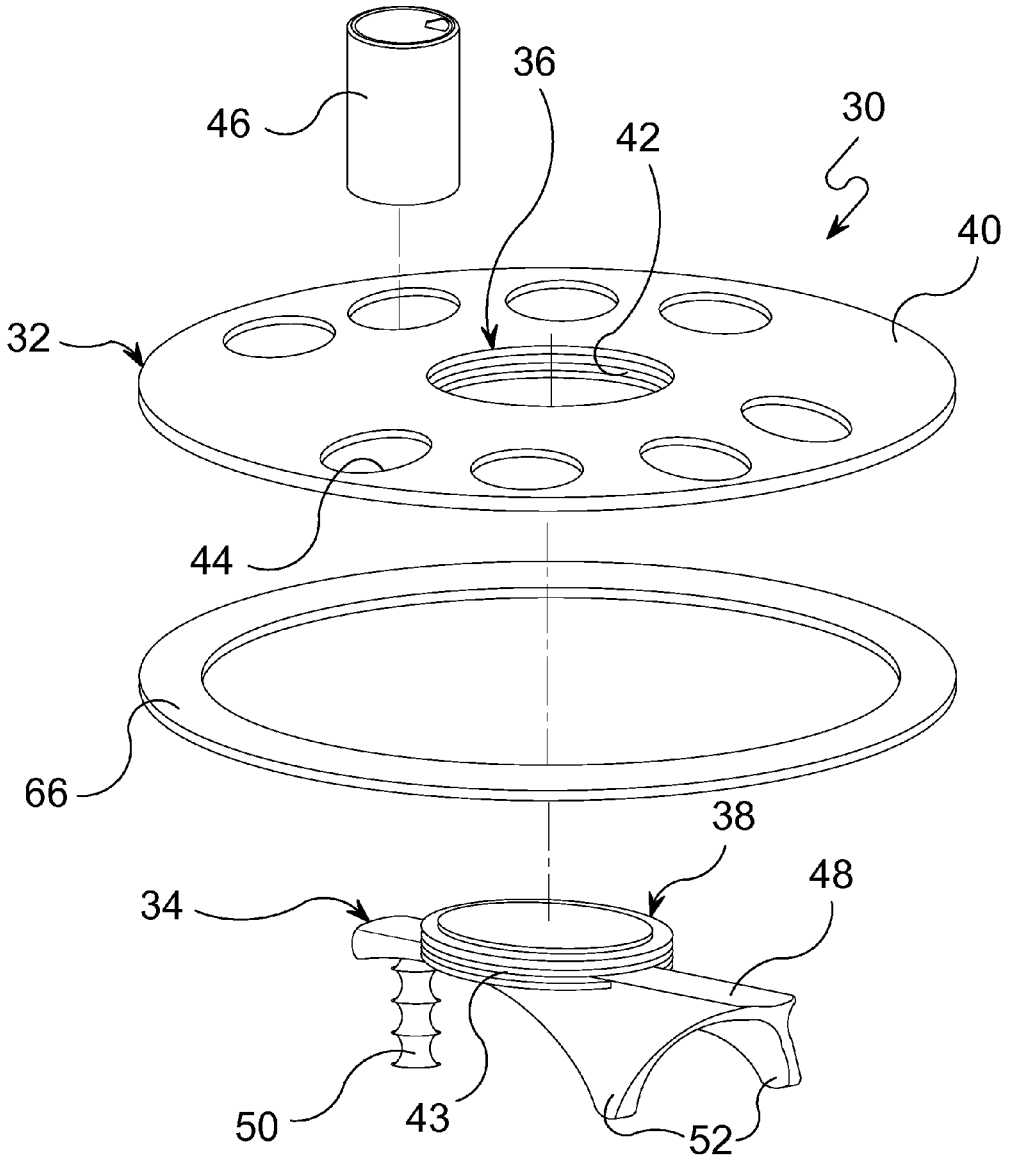

FIG. 15 is a top exploded perspective view of the serving tray apparatus of the present invention whereby the container support portion is comprised of an upper ridged plate having a centrally disposed threaded through bore with a plurality of arrayed apertures and a subjacently positioned lower ring that extends fully or partially across the plurality of arrayed apertures thereby supporting the base of a beverage container on the lower ring.

Figure 16:
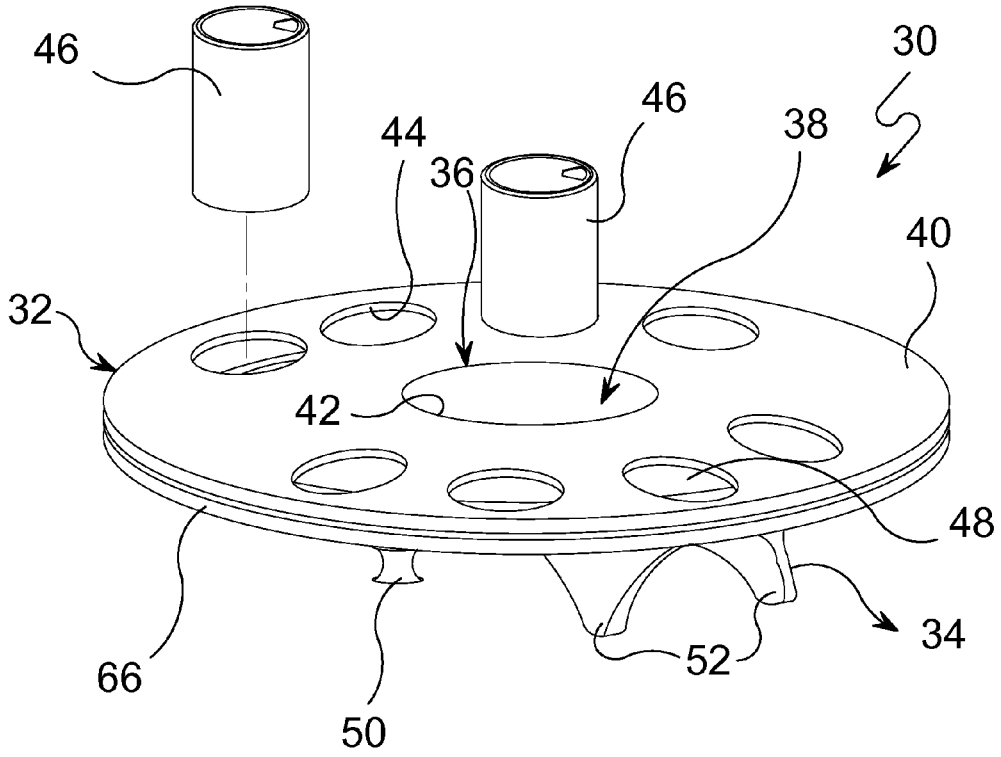

FIG. 16 is an assembled perspective view of the serving tray apparatus of the present invention in use whereby the container support portion is comprised of an upper ridged plate having a centrally disposed threaded through bore with a plurality of arrayed apertures and a subjacently positioned lower ring that extends fully or partially across the plurality of arrayed apertures thereby supporting the base of a beverage container on the lower ring.

Figure 17:
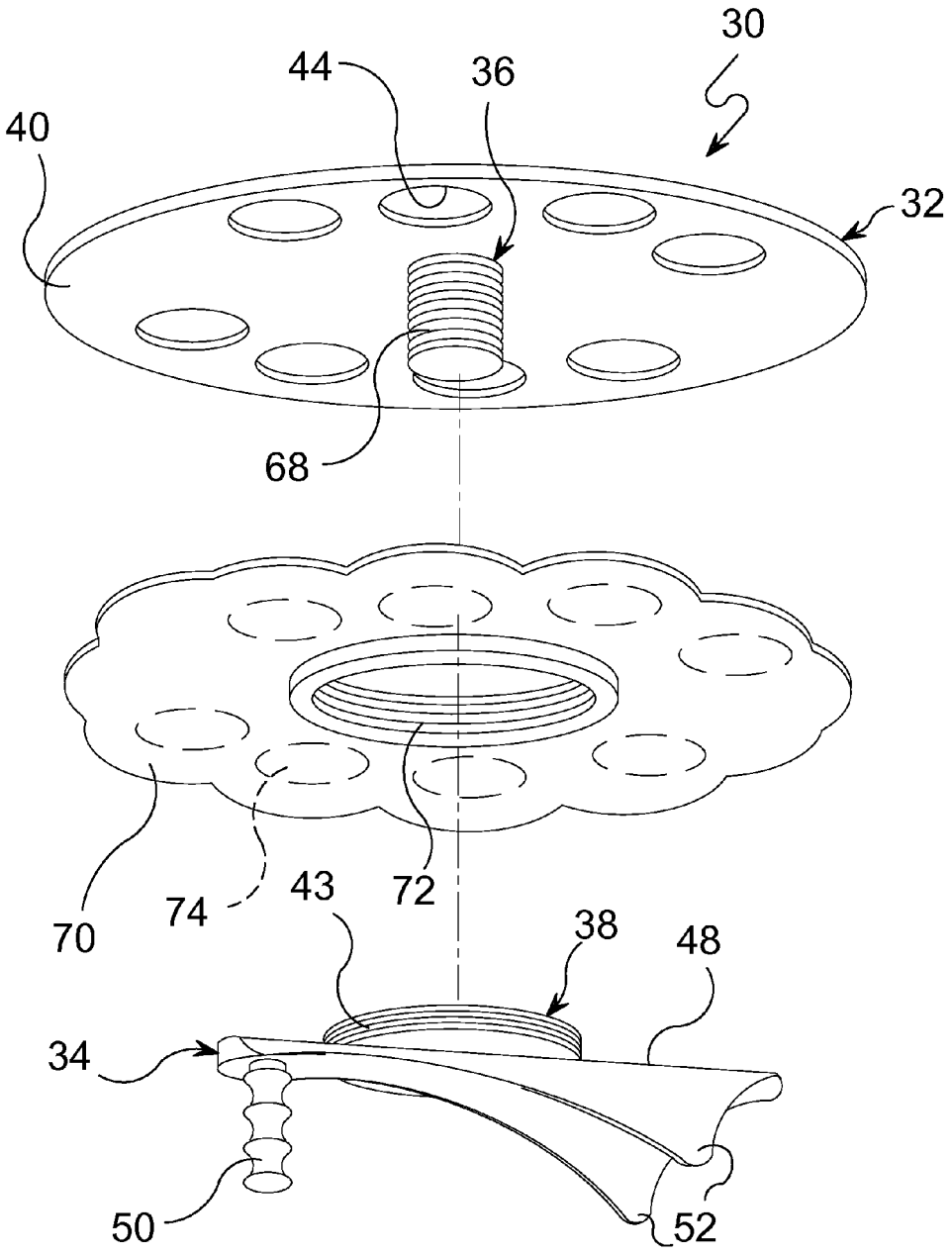

FIG. 17 is a bottom exploded perspective view of the serving tray apparatus of the present invention whereby the container support portion is comprised of an upper ridged plate having a threaded post with a plurality of arrayed apertures therearound and a fixedly attached subjacent lower ridged plate thereunder.

Figure 18:
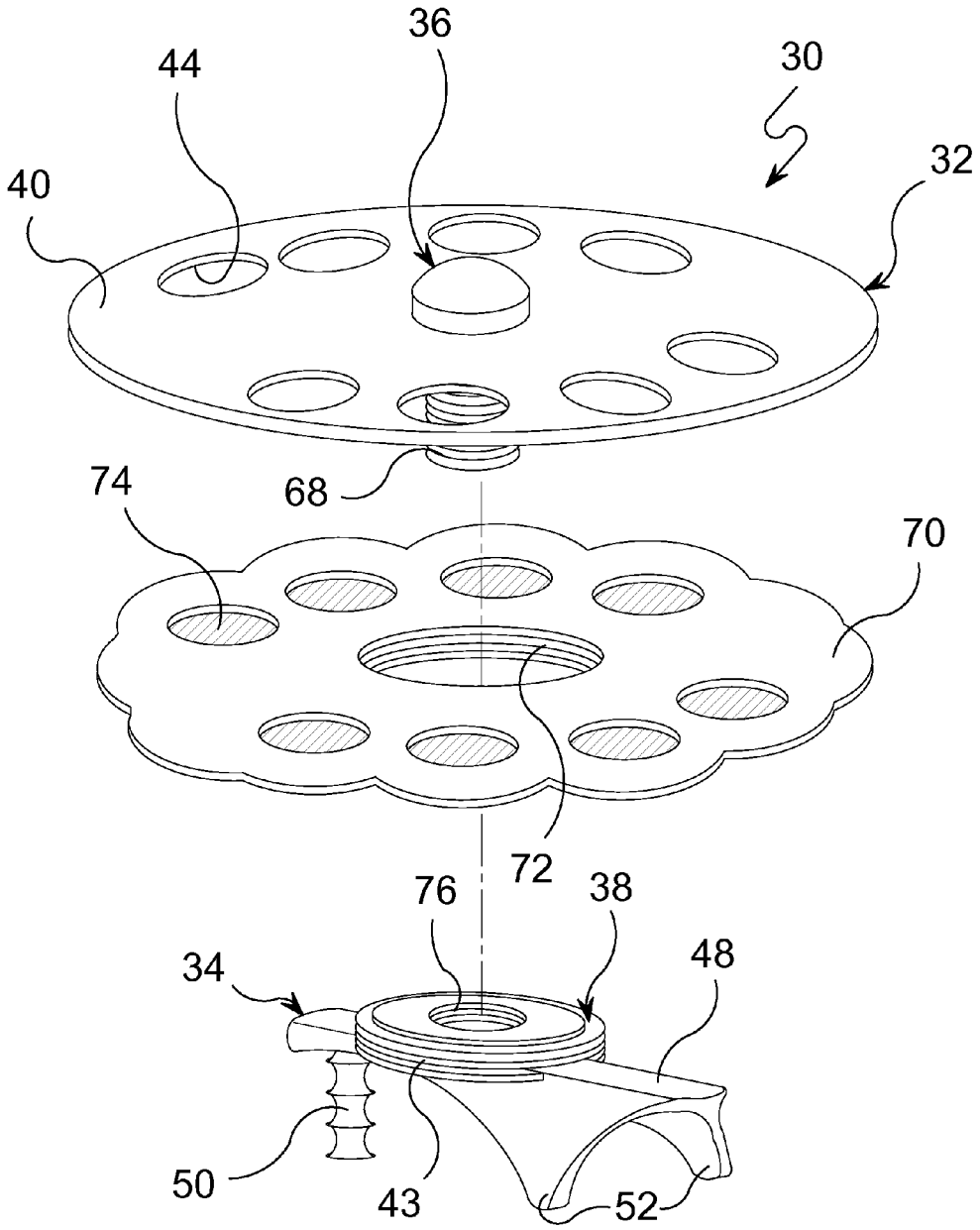

FIG. 18 is a top exploded perspective view of the serving tray apparatus of the present invention whereby the container support portion is comprised of an upper ridged plate having a threaded post with a plurality of arrayed apertures therearound and a fixedly attached subjacent lower ridged plate thereunder.

Figure 19:
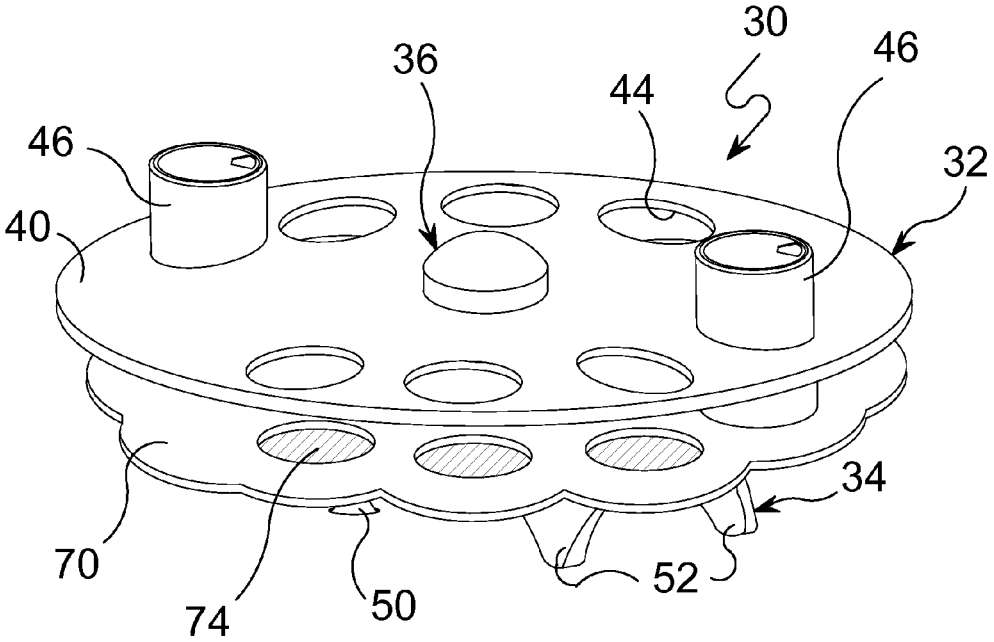

FIG. 19 is a top assembled perspective view of the serving tray apparatus of the present invention in use whereby the container support portion is comprised of an upper ridged plate having a threaded post with a plurality of arrayed apertures therearound and a fixedly attached subjacent lower ridged plate thereunder supporting a respective beverage container in a respective aperture in the lower ridged plate.

Figure 20:
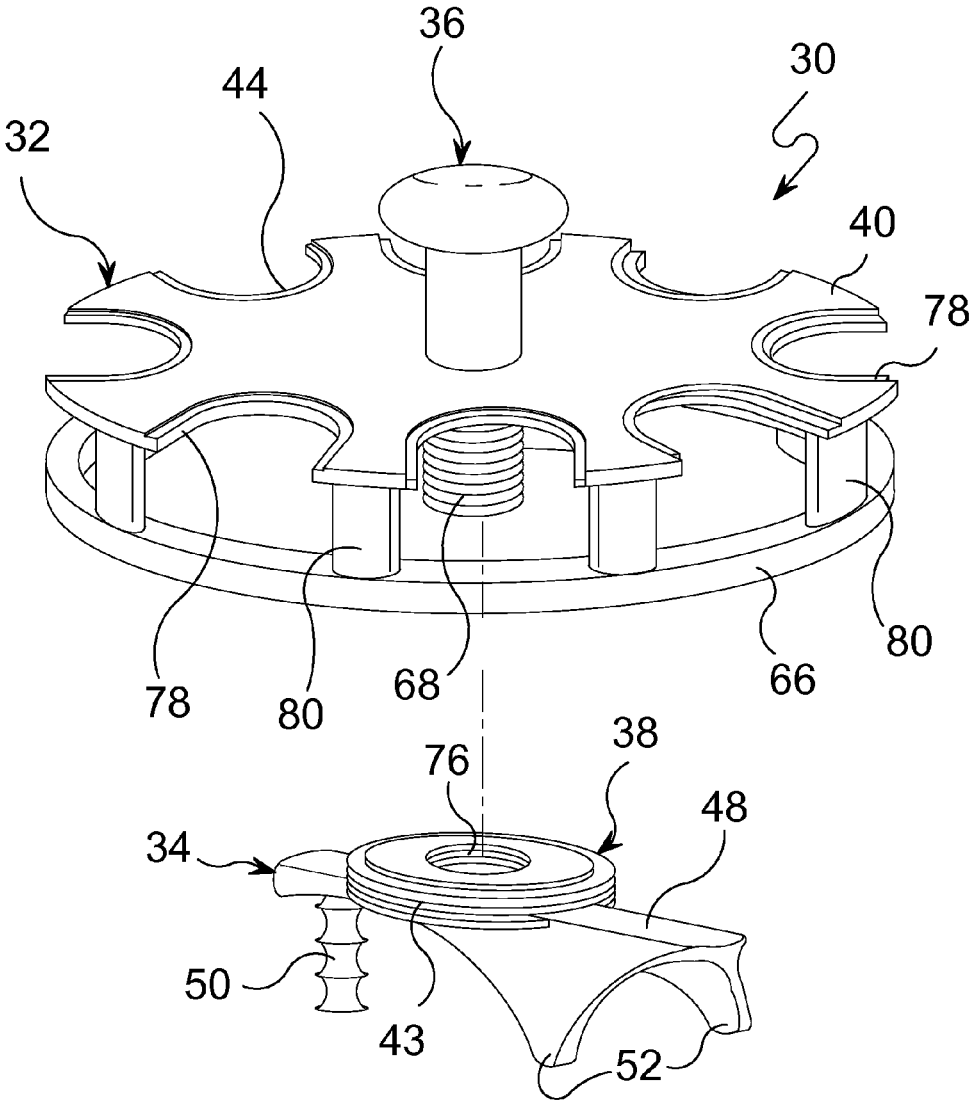

FIG. 20 is a top exploded perspective view of the serving tray apparatus of the present invention comprising a container support portion having an upper ridged plate with U-shaped apertures and a subjacent lower ring with a plurality of spacers fixedly positioned between the upper ridged plate and the lower ring.

DESCRIPTION OF THE REFERENCED NUMERALS

Turning now descriptively to the drawings, in which similar reference characters denote similar elements throughout the several views, the Figures illustrate the cigarette lighter, bottle opener and compass multi-tool of the present invention. With regard to the reference numerals used, the following numbering is used throughout the various drawing figures.

30 serving tray apparatus
32 container support portion of apparatus 30
34 hand/forearm engaging portion of apparatus 30
36 first fastener of apparatus 30
38 second fastener of apparatus 30
40 ridged plate of container support portion 32
42 threaded bore for first fastener 36
43 externally threaded upstanding boss for second fastener 38
44 aperture in ridged plate 40
46 beverage container
48 longitudinal body of hand/forearm engaging portion 34
50 hand grip of hand/forearm engaging portion 34
52 wing on longitudinal body 48
54 dovetail track mounting strip for first fastener 36
56 dovetail rail for second fastener 38
58 flanged receptacle of apparatus 30
60 slot in ridged plate 40
62 goblet/wine glass for beverage container 46
63 stem of goblet/wine glass 62
64 cup portion of goblet/wine glass 62
66 ring of apparatus 30
68 threaded post for first fastener 36
70 second rigid plate of apparatus 30
72 threaded through bore in second rigid plate 70
74 recessed cavity in second rigid plate 70
76 internally threaded aperture for second fastener 38
78 U-shaped cutout in aperture 44
80 spacer of apparatus 30

DETAILED DESCRIPTION OF THE PREFERRED EMBODIMENT

The following discussion describes in detail the present invention with several variations thereof. This discussion should not be construed, however, as limiting the invention to those particular variations, since practitioners skilled in the art will recognize numerous other variations as well. For definition of the complete scope of the present invention, the reader is directed to appended claims.

Figure 1:
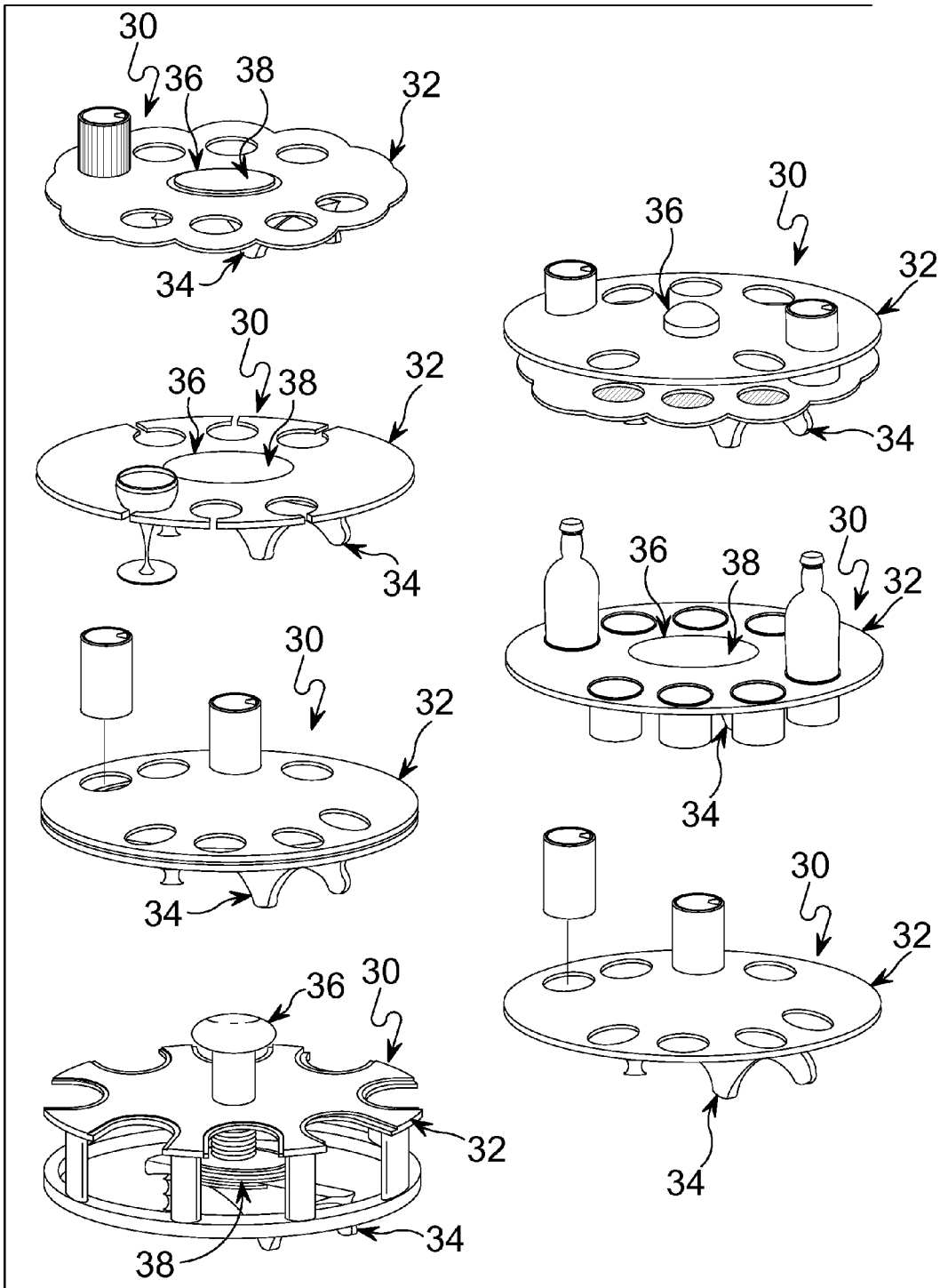
FIG. 1 is a plurality of illustrative top perspective views of the serving tray apparatus of the present invention incorporating various elements.

Referring to FIG. 1, shown are illustrative variations of the serving tray apparatus 30 of the present invention. Shown are several variations of the serving tray apparatus 30 comprising a container support portion 32 and a hand/forearm engaging portion 34 releasably attached together through mating fasteners 36, 38 forming an integral part of the container support portion 32 and the hand/forearm engaging portion 34.

Figure 2:
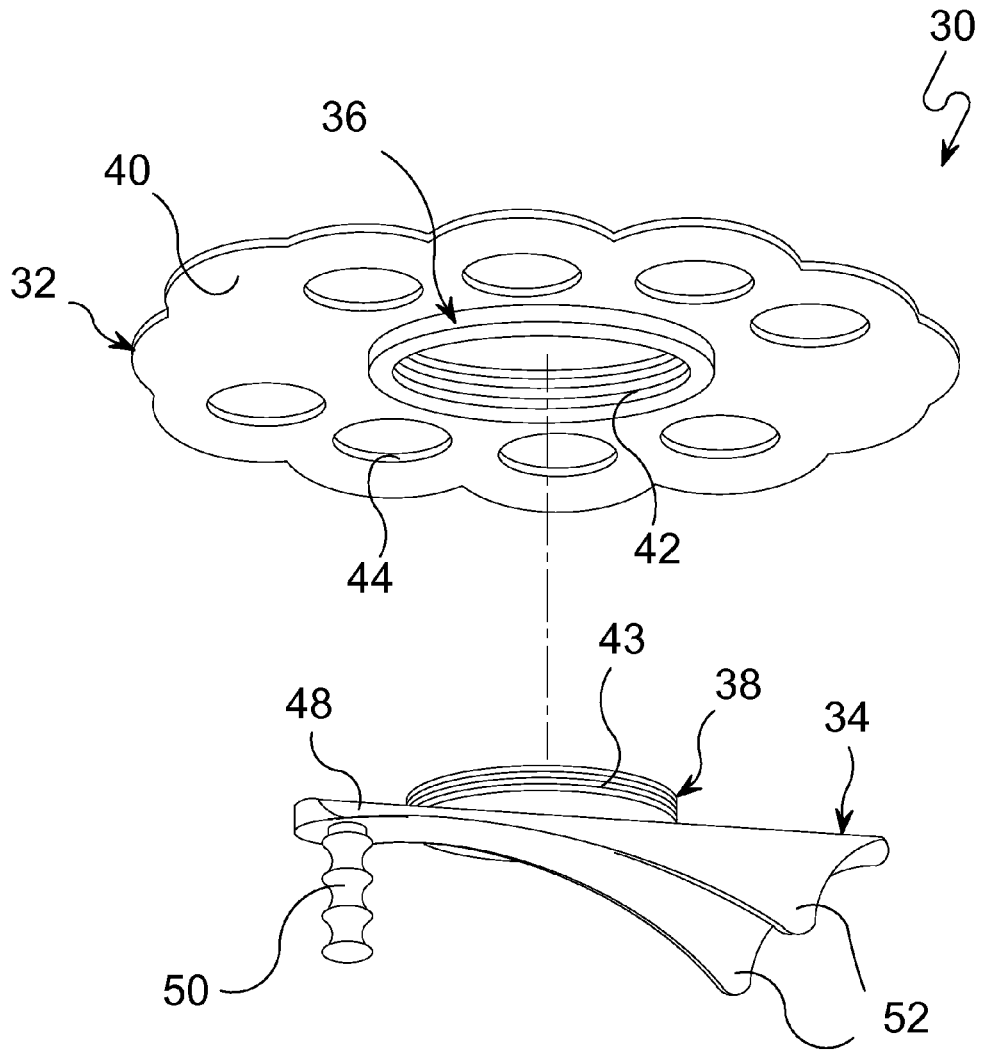
FIG. 2 is an exploded bottom perspective view of the serving tray apparatus of the present invention using a threaded fastener for attaching the container support portion to the hand/forearm engaging portion.
Figure 3:
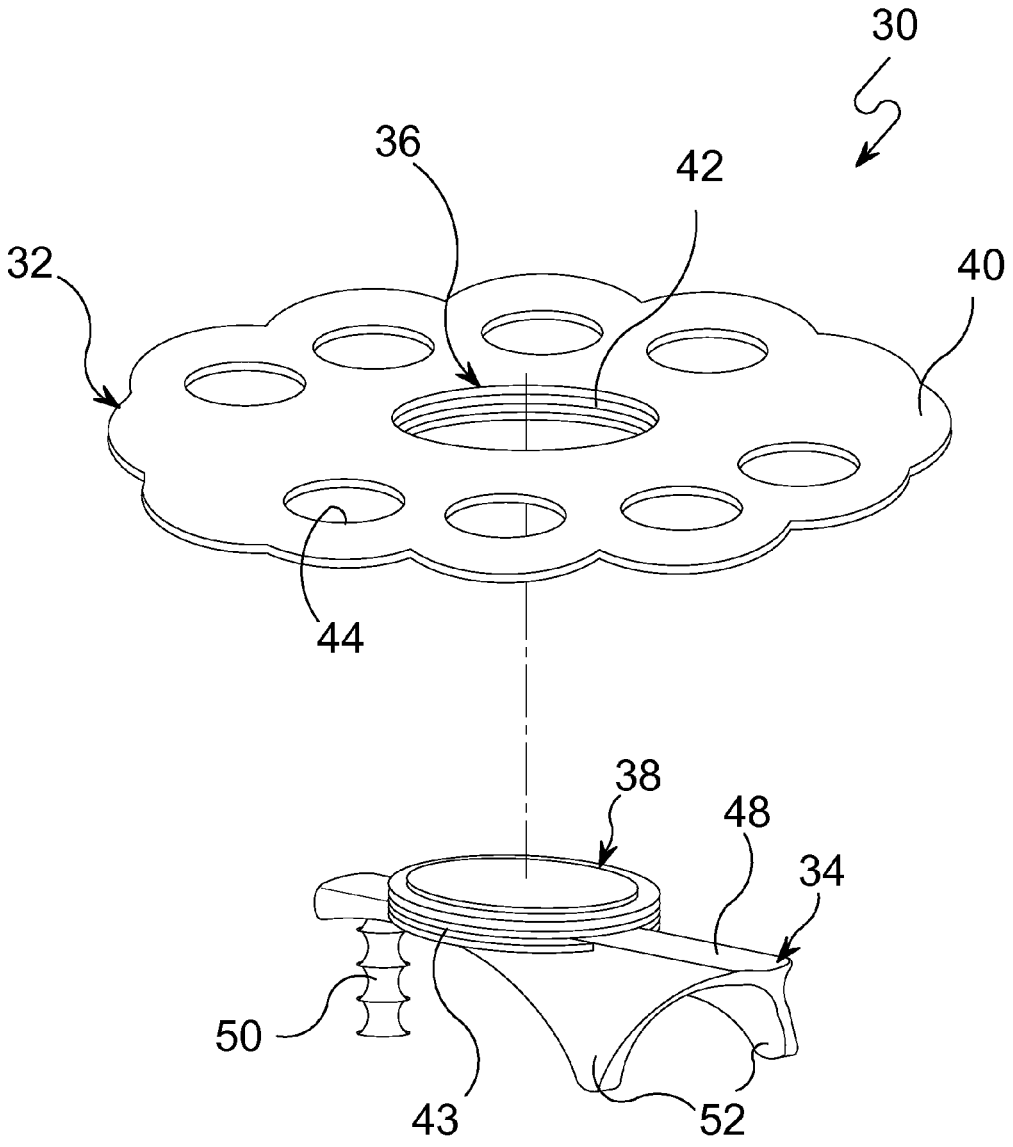
FIG. 3 is an exploded top perspective view of the serving tray apparatus of the present invention using a threaded fastener for attaching the container-support portion to the hand/forearm engaging portion.
Figure 4:
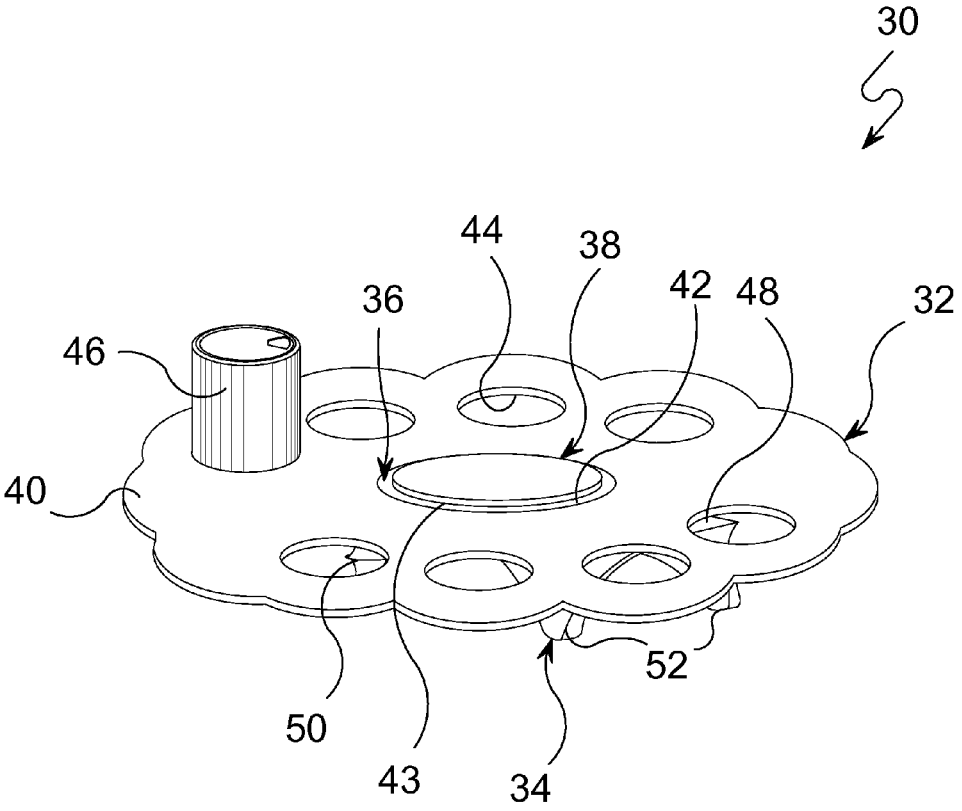
FIG. 4 is an assembled top perspective view of the serving tray apparatus of the present invention using a threaded fastener for attaching the container support portion to the hand/forearm engaging portion.

Referring to FIGS. 2 through 4 shown is the serving tray apparatus 30 of the present invention. Illustrated in FIGS. 2 and 3 are exploded views of the container support portion 32 comprising a rigid plate 40 having a centrally disposed threaded bore 42 being the first fastener 36 with radially arrayed apertures 44 for receiving and supporting a beverage container 46 in a respective aperture 44, as shown in FIG. 4. Also shown is the hand/forearm engaging portion 34 having a longitudinal body 48 with a hand grip 50 on one end with the longitudinal body 48 extending therefrom into a pair of spaced apart downwardly depending wings 52 for engaging a user's forearm. The mating second fastener 38 being an externally threaded upstanding boss 43 is fixed to the top of the longitudinal body 48 for providing means for attaching to the first fastener 36 of the container support portion 32. FIG. 4 depicts an assembly view of the present invention. The terminus ends of the vertically depending hand grip 50 and the longitudinal body 48 are substantially coplanar thereby providing a three point stand for the serving tray apparatus 30 when placed on a horizontal surface, such as a table.

Figure 5:
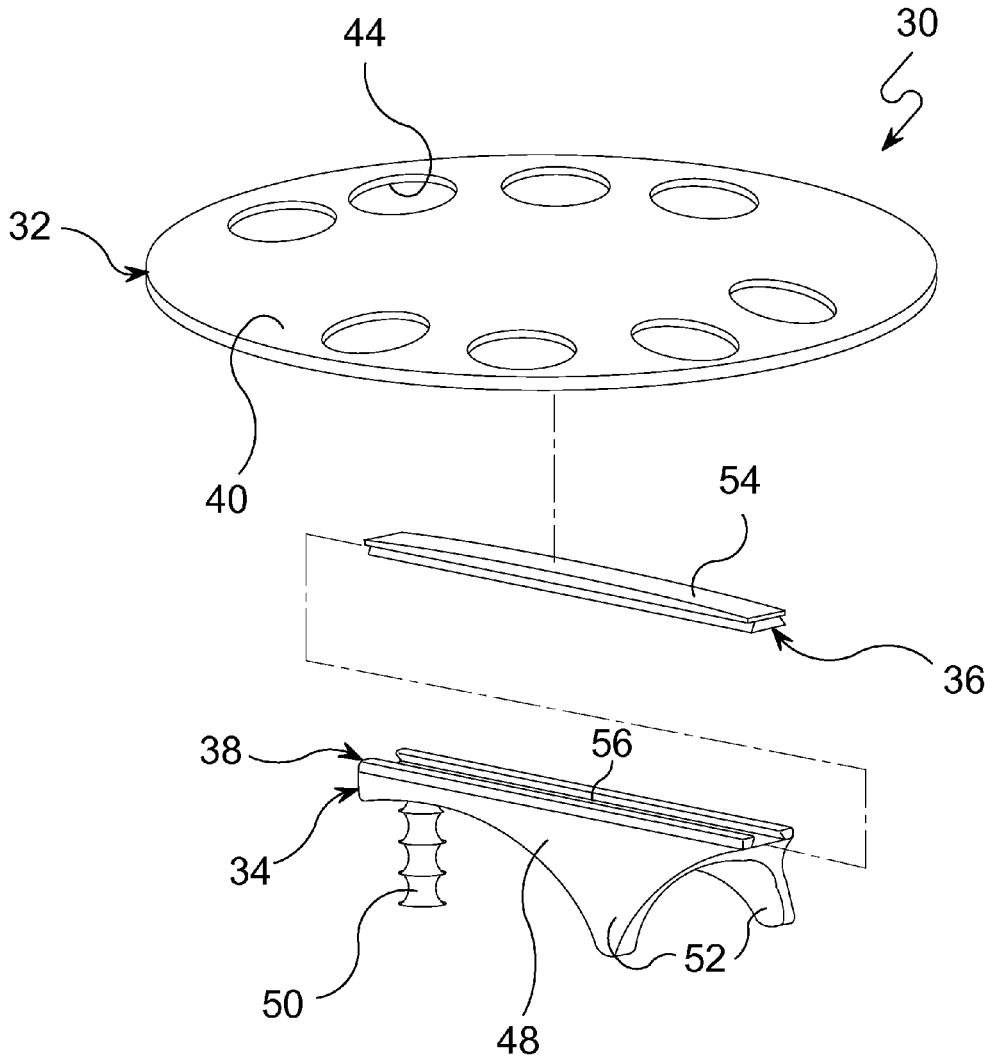
FIG. 5 is an exploded top perspective view of the serving tray apparatus of the present invention using a dovetail fastener for attaching the container support portion to the hand/forearm engaging portion.
Figure 6:
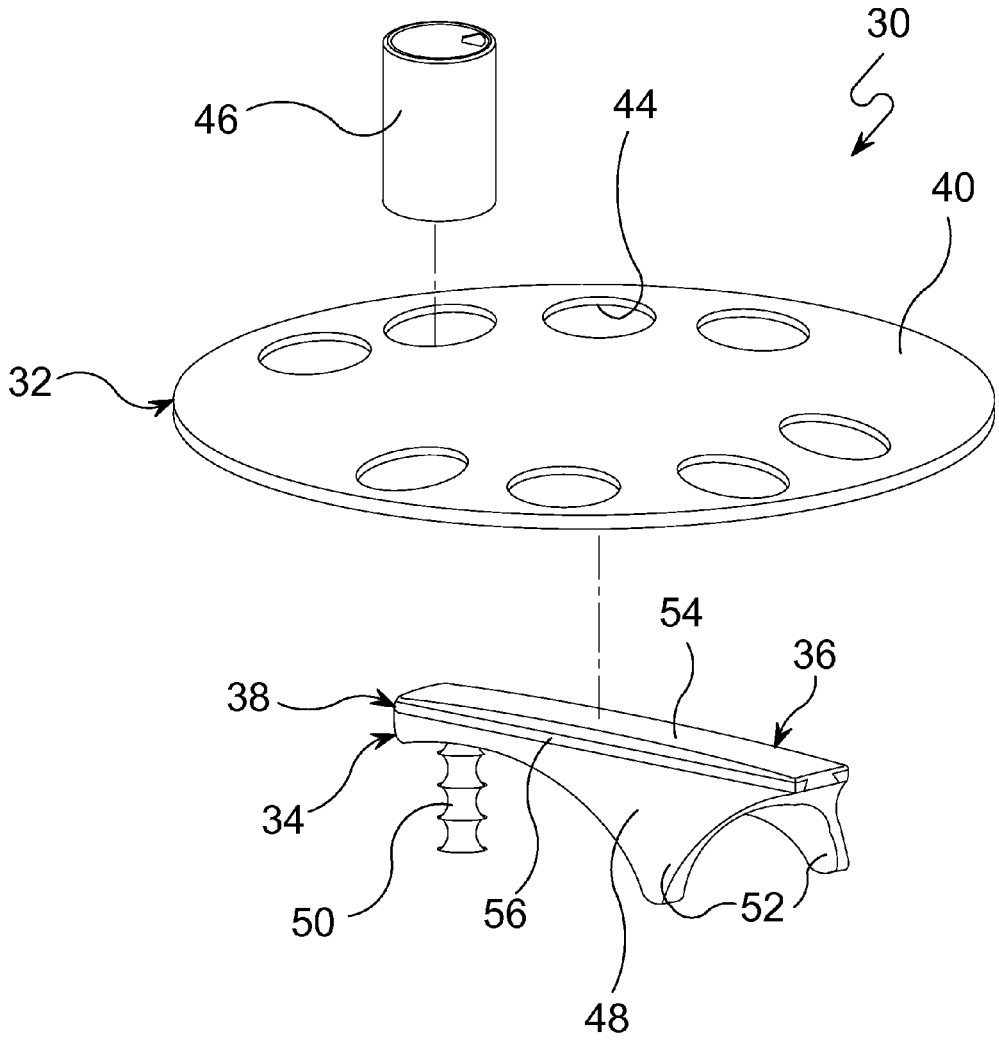
FIG. 6 is a partial exploded top perspective view of the serving tray apparatus of the present invention using a dovetail fastener for attaching the container support portion to the hand/forearm engaging portion.
Figure 7:
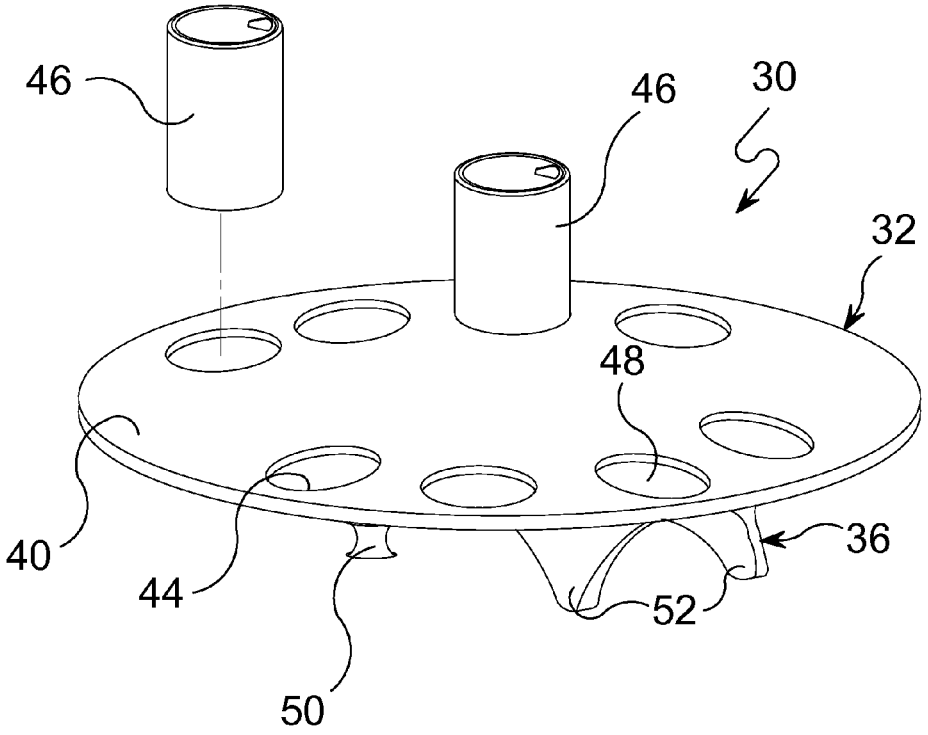
FIG. 7 is an assembled top perspective view of the serving tray apparatus of the present invention using a dovetail fastener for attaching the container support portion to the hand/forearm engaging portion.

Referring to FIGS. 5 through 7, shown are exploded views and an assembled view of another additional variation of the present invention. Illustrated in FIGS. 5 and 6 are exploded views of the serving tray apparatus 30 consisting of a container support portion 32 being a ridged plate 40 having a plurality of radially arrayed apertures 44 for receiving and supporting a beverage container 46 in a respective aperture 44, as shown in FIG. 7. Also shown is the hand/forearm engaging portion 34 having a longitudinal body 48 with a hand grip 50 on one end with a pair of spaced apart downwardly depending wings 52 for engaging a user's forearm. FIG. 7 depicts an assembly view of the present invention. As illustrated, the mating first and second fasteners 36, 38 are for attaching the container support portion 32 to the hand/forearm engaging portion 34 which are a dovetail track mounting strip 54 fixed to the underside of the ridged plate 40 of the container support portion 32 and a dovetail rail 56 fixed onto the longitudinal body 48 of the hand/forearm engaging portion 34.

Figure 8:
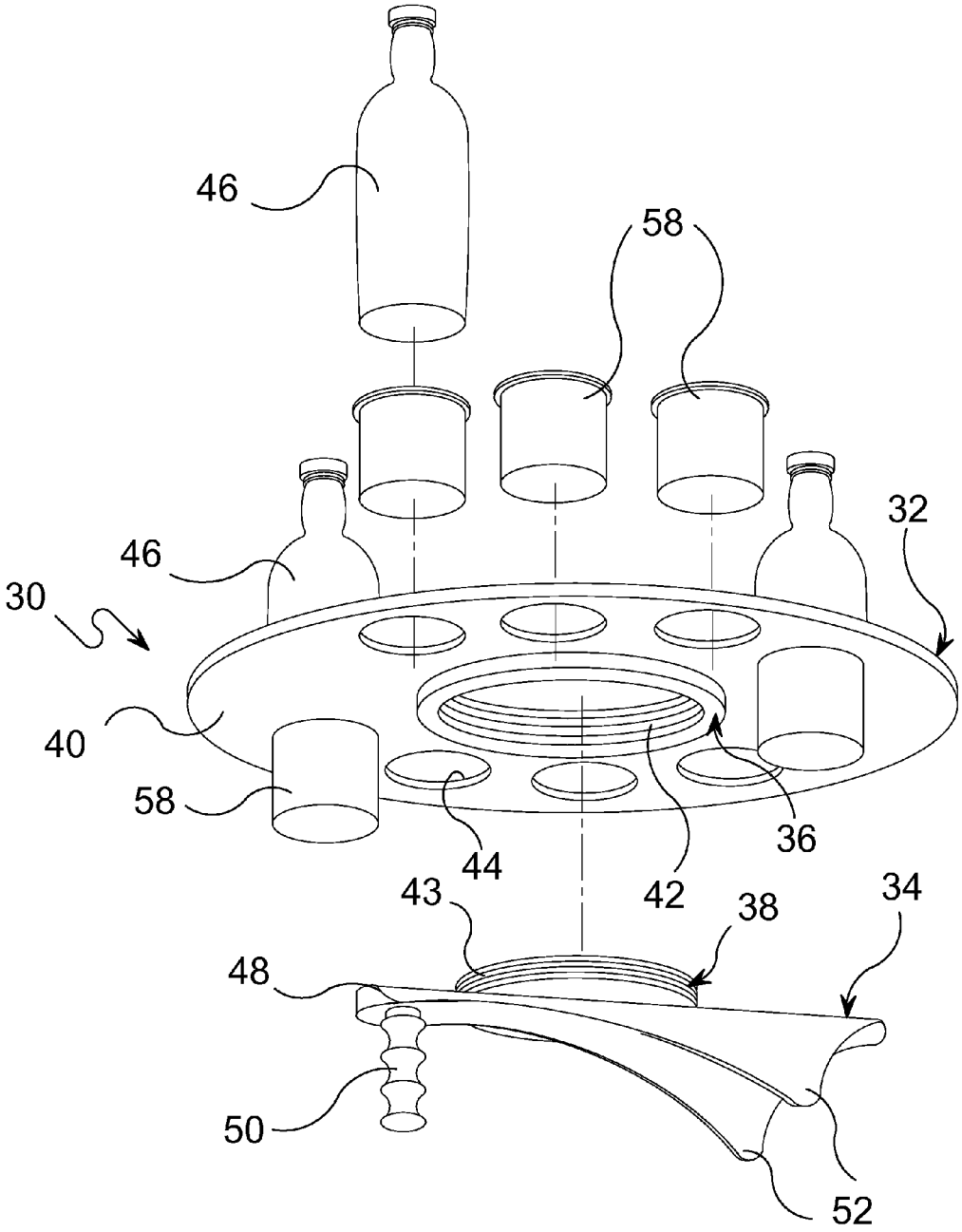
FIG. 8 is an exploded bottom perspective view of the serving tray apparatus of the present invention using a threaded fastener for attaching the container support portion to the hand/forearm engaging portion further incorporating flanged beverage receptacles positioned within the serving tray apertures for placing beverage containers therein.
Figure 9:
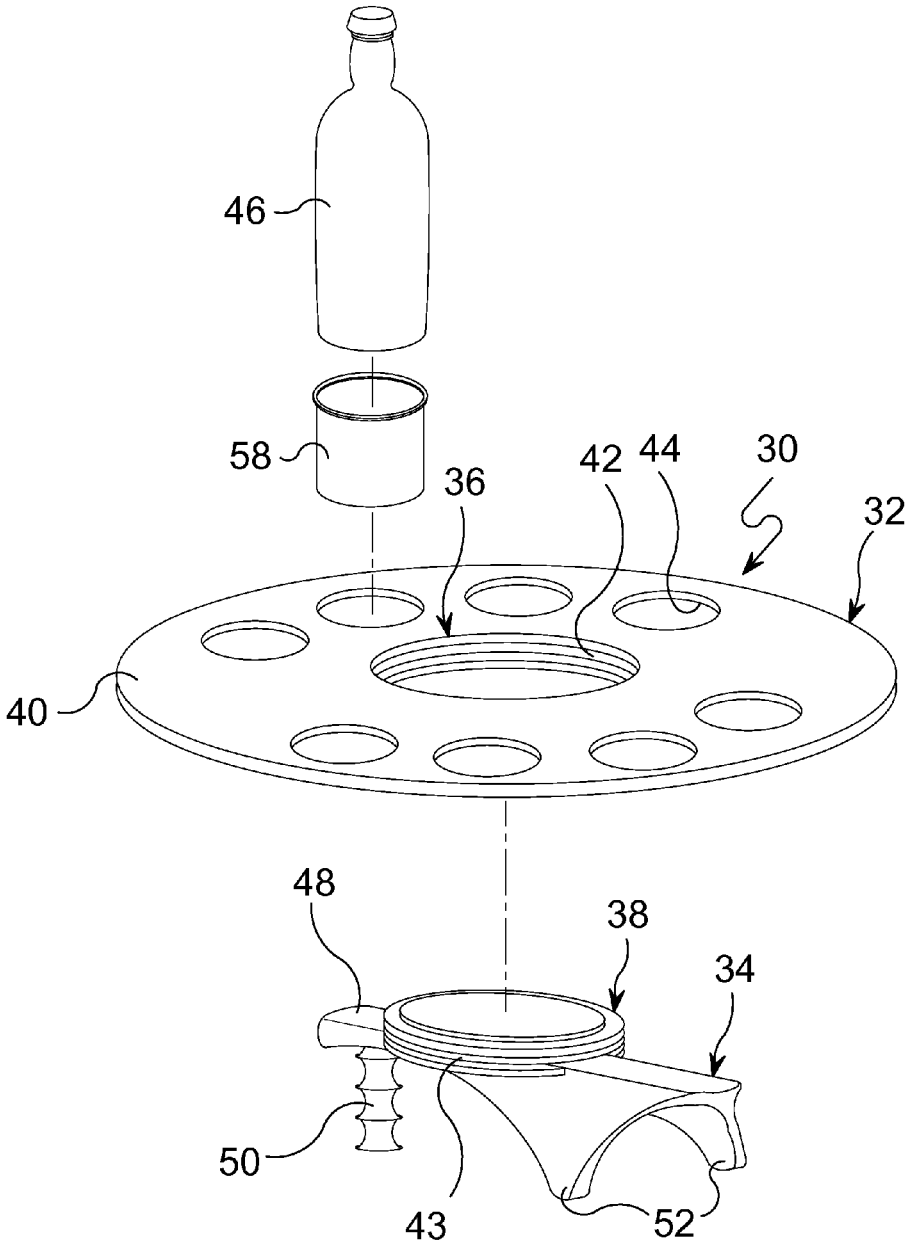
FIG. 9 is an exploded top perspective view of the serving tray apparatus of the present invention using a threaded fastener for attaching the container support portion to the hand/forearm engaging portion further incorporating flanged beverage receptacles positioned within the serving tray apertures for placing beverage containers therein.
Figure 10:
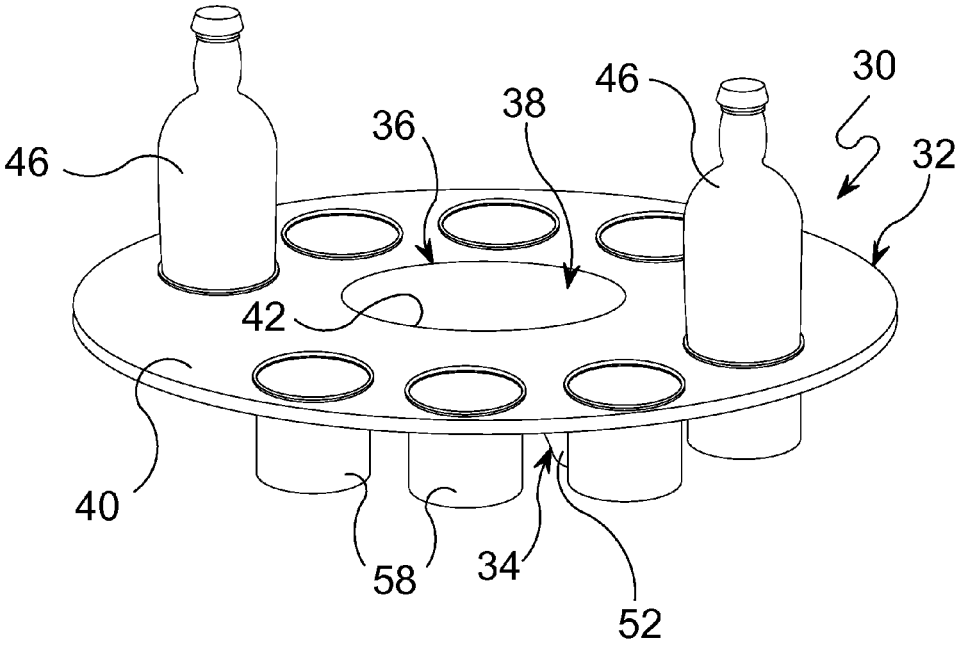
FIG. 10 is an assembled top perspective view of the serving tray apparatus of the present invention using a threaded fastener for attaching the container support portion to the hand/forearm engaging portion further incorporating flanged beverage receptacles positioned within the serving tray apertures for placing beverage containers therein.

Referring to FIGS. 8 through 10, shown are exploded views and an assembled view of another additional variation of the present invention. The present invention is a serving tray apparatus 30 having a ridged plate 40 for moving a plurality of beverage containers 46 from one location to another by providing a hand/forearm engaging portion 34 incorporating a second fastener 38 with the first mating fastener 36 forming an integral part of the ridged plate 40, whereby the ridged plate 40 can be releasably attached to the hand/forearm engaging portion 34. The present invention further provides a corresponding plurality of flanged receptacles 58 with each flanged receptacle 58 positioned into each aperture 44, thereby providing for placement of a beverage container 46 into the flanged receptacle 58, as shown in FIG. 10.

Referring to FIGS. 11 through 13, are exploded views and an assembled view of yet another additional variation of the present invention. Illustrated in FIGS. 11 and 12 are exploded views of the container support portion 32 comprising a rigid plate 40 having a centrally disposed threaded bore 42 with radially arrayed apertures 44 for receiving and supporting a beverage container 46 in a respective aperture 44 further comprising a slot 60 extending from the edge of the ridged plate 40 to an aperture 44, as shown in FIG. 11. FIG. 12 depicts a beverage container 44, such as a goblet or wine glass 62, which has a stem 63 that can be passed through the slot 60 with the cup portion 64 and then supported by the aperture 44. Also shown is the hand/forearm engaging portion 34 having a longitudinal body 48 with a hand grip 50 on one end with a pair of spaced apart downwardly depending wings 52 on an opposite end for engaging a user's forearm. The mating second fastener 38 is fixed to the top of the longitudinal body 48 providing means for attaching to the container support portion 32. FIG. 13 depicts an assembly view of the present invention. The terminus ends of the vertically depending hand grip 50 and longitudinal body 48 are substantially coplanar thereby providing a three point stand for the serving tray apparatus 30 when placed on a horizontal surface, such as a table.

Referring to FIGS. 14 through 16, shown is the container support portion 32 comprising a ridged plate 40 having a threaded through bore 42 with a plurality of arrayed apertures 44 therearound and a fixedly attached subjacent ring 66. Illustrated in FIGS. 14 and 15 are exploded views of the serving tray apparatus 30 consisting of the rigid plate 40 having a plurality of radially arrayed apertures 44, for receiving a beverage container 46 in a respective aperture 44 and a subjacently fixed ring 66 that fully or partially extends across the plurality of arrayed apertures 44, thereby forming support for the base of a beverage container 46 has shown in FIG. 16.

Referring to FIGS. 17 through 19 are exploded views of the serving tray apparatus 30 while FIG. 19 depicts an assembled view in use. The container support portion 32 comprises a ridged plate 40 having a plurality of radially positioned apertures 44 with a centrally disposed downwardly depending threaded post 68 and a subjacent second ridged plate 70 having a threaded through bore 72 with a plurality of radially positioned recessed cavities 74 that when assembled are co-aligned with the apertures 44. The second ridged plate 70 is threadedly attached to the exterior thread of the second fastener 38 and the threaded post 68 is threadedly attached to a threaded through bore 76 of the second fastener 38, whereby the length of the threaded post 68 keeps the ridged plate 40 and second ridged plate 70 spaced apart.

Referring to FIG. 20, depicts an additional variation of the present invention having a serving tray apparatus 30 further comprising a container support portion 32 having an ridged plate 40 with apertures 44 each having a U-shaped cutout 78 and a subjacent ring 66 with a plurality of spacers 80 fixedly positioned between the ridged plate 40 and the ring 66, wherein the ring 66 extends fully or partial across the apertures 44 of the ridged plate 40, thereby supporting the base of a beverage container 46 upon the fixedly attached ring 66.

What is claimed is:

1. A serving tray apparatus which comprises:

a) a container support portion comprising a rigid plate having a plurality of radially arrayed apertures for receiving and supporting beverage containers within and extending completely through the apertures and below said rigid plate;

b) a forearm engaging portion comprising a longitudinal body having a vertically depending hand grip at a first end and a pair of spaced apart downwardly depending wings at a second end for engaging a user's forearm, whereby the hand grip and the wings are substantially coplanar to provide a three point stand when placed on a horizontal surface;

c) said longitudinal body comprising downwardly extending sides sloping from distal ends of said wings to a base of said hand grip where said hand grip meets said longitudinal body;

d) means for releasably attaching the container support portion to the forearm engaging portion comprising a first fastener for the container support portion and a second fastener for the forearm engaging portion, whereby the first fastener mates with the second fastener;

e) the first fastener comprising the rigid plate having a centrally disposed threaded bore and the second fastener comprising an externally threaded upstanding boss on the forearm engaging portion which engages with the internally threaded bore of the first fastener; and f) a plurality of flanged receptacles, with each flanged receptacle positioned into and extending completely through each aperture in the rigid plate, and each receptacle having a side wall and a bottom closing wall thereby providing for placement of the beverage containers into the flanged receptacles.

* * * * *